US006470517B1

(12) United States Patent
Kang

(10) Patent No.: US 6,470,517 B1
(45) Date of Patent: Oct. 29, 2002

(54) FOLDABLE BED FOR VEHICLE

(76) Inventor: Jun-Yeon Kang, 103-709 Jongwon A.P.T., 222-9 Yongam-Ri, Samho-Myeon, Yeongam-Gun, Jeonranamdo (KR)

( * ) Notice: Subject to any disclaimer, the term of this patent is extended or adjusted under 35 U.S.C. 154(b) by 0 days.

(21) Appl. No.: 09/714,534

(22) Filed: Nov. 17, 2000

(30) Foreign Application Priority Data

Nov. 26, 1999 (KR) ..... 99-53194

(51) Int. Cl.[7] ..... A47C 17/64
(52) U.S. Cl. ..... 5/118; 5/116; 5/117; 5/176.1
(58) Field of Search ..... 5/112, 116, 117, 5/118, 119, 176.1; 296/20

(56) References Cited

U.S. PATENT DOCUMENTS 1,503,391 A * 7/1924 Teske ..... 5/117
1,620,346 A * 3/1927 Harper ..... 5/118
1,678,441 A * 7/1928 McGrew ..... 5/117
1,744,701 A * 1/1930 Ike ..... 5/118
2,232,353 A * 2/1941 Votypka ..... 5/118
3,882,557 A * 5/1975 Stehlik ..... 5/118
4,443,034 A * 4/1984 Beggs ..... 5/118
4,756,034 A 7/1988 Stewart
5,039,155 A 8/1991 Suman et al.
5,195,194 A 3/1993 Bradley et al.

* cited by examiner

*Primary Examiner*—Michael F. Trettel
(74) *Attorney, Agent, or Firm*—Burns, Doane, Swecker & Mathis LLP

(57) ABSTRACT

A foldable bed for a vehicle, and more particularly a foldable bed for a vehicle which can be folded for storage in a trunk and unfolded for installation in the vehicle in case of necessity. It is an object of the invention to provide a foldable bed for a vehicle which can utilize spaces in the passenger's seat and back side of seats to serve for a rest in case of tiredness and to easily evacuate an emergent patient. In order to obtain the foregoing object of the invention, it is provided a foldable bed for a vehicle comprising: two bodies which has first and second folding parts, pivotal parts, rotational members at the leading ends of the pivotal parts and fixing members at ends thereof opposite to the rotational parts; first fixing parts which are equipped in a trunk of the vehicle to be coupled with the rotational members; second fixing part which are equipped in the front side of a passenger's seat in the vehicle to be coupled with the fixing members of the bodies; and a bottom cloth covering the bodies.

3 Claims, 4 Drawing Sheets

FOLDABLE BED FOR VEHICLE

This application claims priority under 35 U.S.C. §§ 119 and/or 365 to 53194/1999 filed in Republic of Korea on Nov. 26, 1999; the entire content of which is hereby incorporated by reference.

BACKGROUND OF THE INVENTION

1. Field of the Invention

The invention generally relates to a foldable bed for a vehicle, and more particularly to a foldable bed for a vehicle which can be folded for storage in a trunk and unfolded for installation in the vehicle in case of necessity.

2. Description of the Related Art

In conventional automobiles when a driver or passenger wishes to relax or rest, the users reclines the seats backward and leans against them while in the seated position, i.e., with their back against the seat. In such cases, however, the curved surface of the seats (e.g., the arch support or lumbar support in the seats) disturbs users from a cozy rest. In addition, these curvatures in the seats make it difficult for the user to turn over their bodies, and it is inconvenient since they are curbed in actions.

SUMMARY OF THE INVENTION

The invention is proposed to solve the foregoing problems, and it is an object of the invention to provide a foldable bed for a vehicle which can utilize the spaces in the passenger's seat and back side of seats to serve for a rest area in case of tiredness and to easily evacuate an emergent patient.

In order to obtain the foregoing object of the invention, it is provided a foldable bed for a vehicle comprising: two side rails which have first and second folding parts, pivotal parts, rotational members at the leading ends of the pivotal parts and fixing members at ends thereof opposite to the rotational parts; first fixing parts which are equipped in a trunk of the vehicle to be coupled with the rotational members; second fixing part which are equipped in the front side of a passenger's seat in the vehicle to be coupled with the fixing members of the side rails; and a bottom cloth covering the side rails.

BRIEF DESCRIPTION OF THE DRAWINGS

The above and other objects, features and advantages of the present invention will become more apparent from the following detailed description when taken in conjunction with the accompanying drawings, in which.

DETAILED DESCRIPTION OF THE PREFERRED EMBODIMENT

Figure 1:
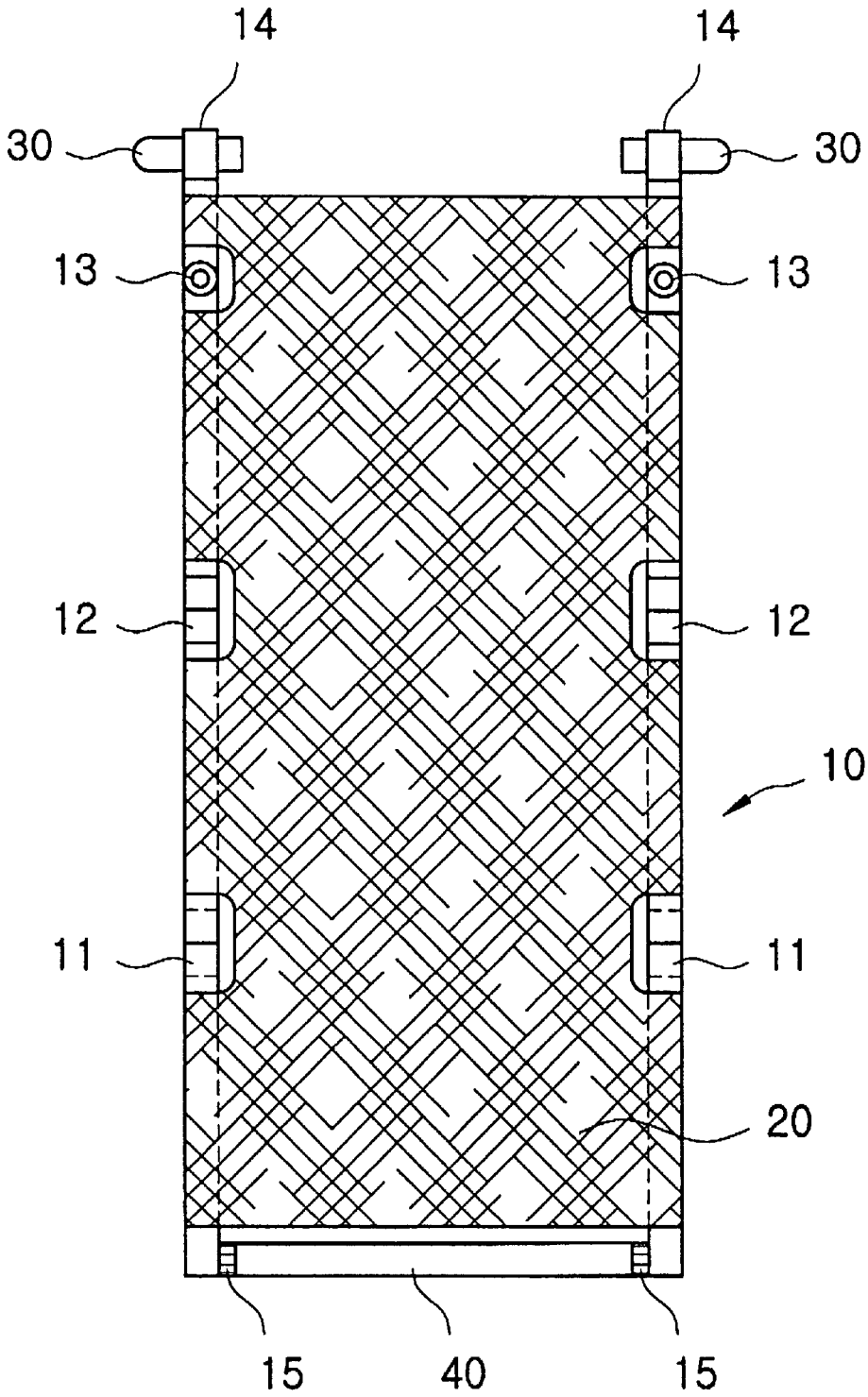
FIG. 1 is a plan view for showing the overall configuration of a foldable bed for a vehicle of the invention.

As shown in FIG. 1, a foldable bed for a vehicle of the invention comprises two bodies 10 which have first and second folding parts 11 and 12, pivotal parts 13, rotational members 14 at the leading ends of the pivotal parts 13, and fixing members 15 at ends of the bodies opposite to the rotational members 14. The foldable bed also comprises first fixing parts 30 which are equipped in a trunk of the vehicle to be coupled with the rotational members 14, second fixing part 40 which are equipped in the front side of a passenger's seat in the vehicle to be coupled with the fixing members 15 of the body 10, and bottom cloth 20 which is covered over the two bodies 10 to form the surface of the bed.

Figure 6:
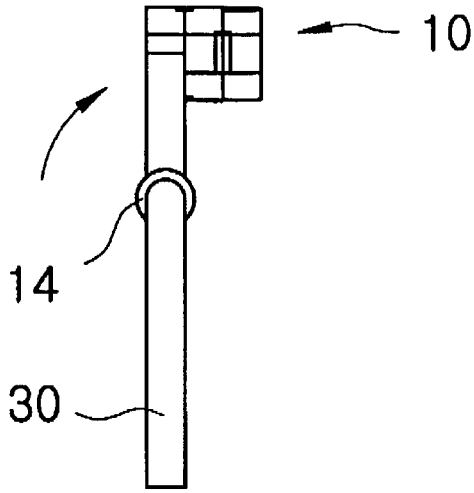
FIG. 6 is a side elevation view for showing the foldable bed for a vehicle shown in FIG. 1, which is contained in a trunk with first and second folding parts being folded and pivotal parts being pivoted.

In order to unfold the bed for a rest in the vehicle, the passenger's seat and the back seat are folded down. The night and left bodies 10 of the foldable bed coupled with the first fixing parts 30 which are equipped in a trunk are rotated 90 degrees, in the direction toward the inside of a cab in the opposite direction when being received into the trunk as shown in FIG. 6. Then the rotational members 14 which connect the bodies 10 and the first fixing parts 30 rotates causing the bodies 10 to rotate 90 degrees toward the inside of the cab about the rotational members 14. Here, the left and right bodies 10 are connected by the bottom cloth covering the bodies, so the bodies 10 rotate at the same time.

Figure 2:
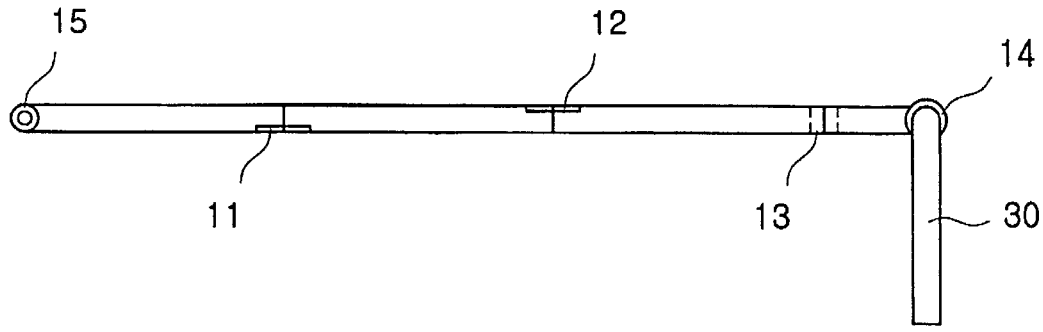
FIG. 2 is a side elevation view of for showing foldable bed for a vehicle shown in FIG. 1.

Then, the pivotal parts 13 of the folded bodies are rotated 90 degrees away from each other. After the folded bodies have been rotated into position, the folded second and first foldable parts 12 and 11 allow the bodies 10 to be unfolded to form straight body side rails as shown in FIG. 2. The bottom cloth 20 which covers the bodies 10 is composed of flexible material, so it is unfolded with the bodies 10. The left and right bodies 10 are connected by the bottom cloth 20 to be unfolded and folded at the same time. After unfolding the left and right bodies 10, a cover (not shown) covering the second fixing part 40 which is provided in the front of the passenger's seat and the fixing members 15 are fixed to the second fixing part 40, thereby completing installation of the foldable bed.

The bottom cloth 20 is provided to cover the bodies 10 and fixed to the ends thereof. The bottom cloth 20 is unfolded with the bodies 10 when the foldable bed is unfolded and is unfolded completely in the width direction of the foldable bed to form a bottom surface on which a man can lie when the fixing members 15 of the bodies 10 and the second fixing part 40 are coupled and fixed.

In the invention, the fixing members 15 and the second fixing part 40 are connected by screw fastening of bolt and nut. However, the fastening method of the fixing members 15 and the second fixing part 40 can adopt a loop mechanism or a locker using push buttons to have the same effect.

After a rest, the foldable bed is contained into the trunk in the reverse manner of installing it. First, the fixing members 15 are released from the second fixing part 40 so that the bodies 10 are straightly unfolded as shown in FIG. 2.

Figure 3:
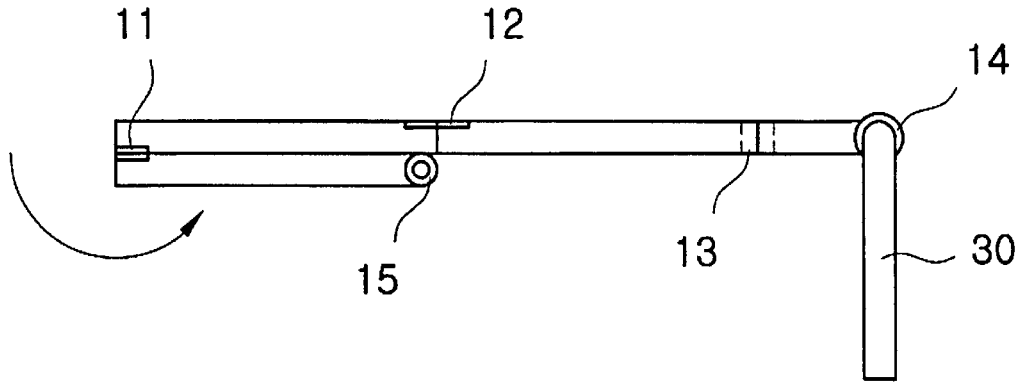
FIG. 3 is a side elevation view for showing the foldable bed for a vehicle shown in FIG. 1 with first folding parts being folded.
Figure 4:
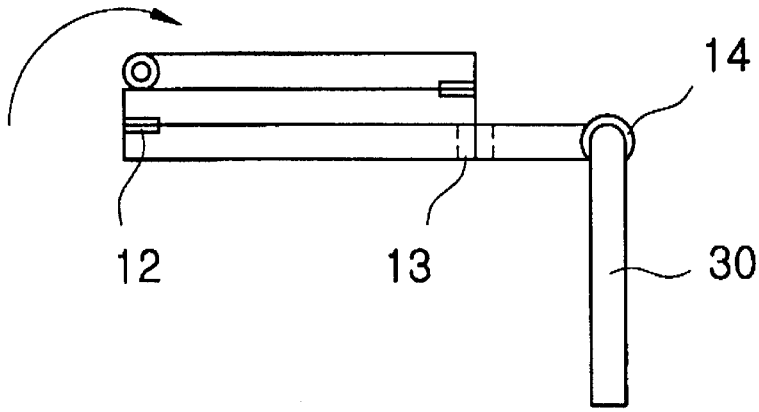
FIG. 4 is a side elevation view for showing the foldable bed for a vehicle shown in FIG. 1 with first and second folding parts being folded.

As shown in FIG. 3 and FIG. 4, the first foldable parts 11 provided to the bodies 10 can be folded in the downward direction, the second foldable parts 12 can be folded in the upward direction on the contrary. When the first foldable parts 11 are folded in the downward direction, the bodies 10 are as shown in FIG. 3. The bottom cloth 20 covering the bodies 10 are composed of flexible material to be folded accompanying folding of the bodies 10, and the two bodies are folded at the same time since they are connected by the bottom cloth 20.

Figure 5:
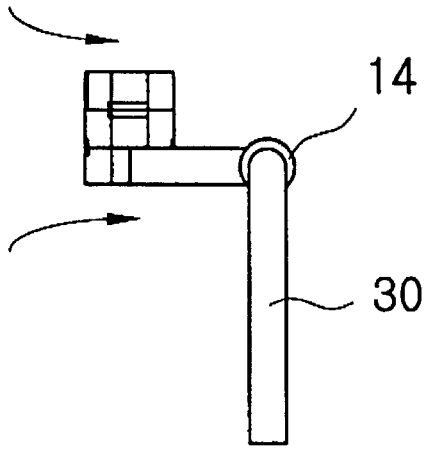
FIG. 5 is a side elevation view for showing the foldable bed for a vehicle shown in FIG. 1 with first and second folding parts being folded and pivotal parts being pivoted.
Figure 7:
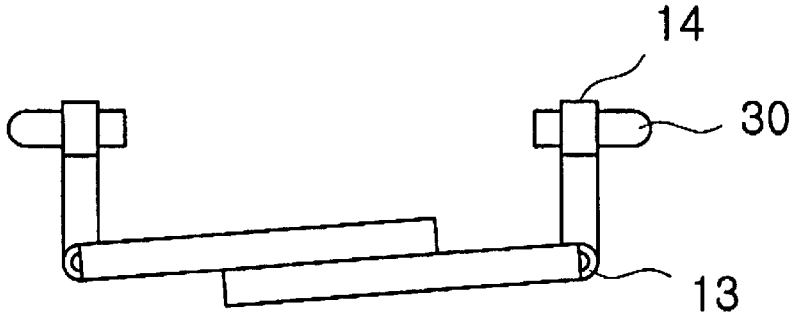
FIG. 7 is a rear elevation view for showing the foldable bed for a vehicle shown in FIG. 1 with first and second folding parts being folded and pivotal parts being pivoted.
Figure 8:
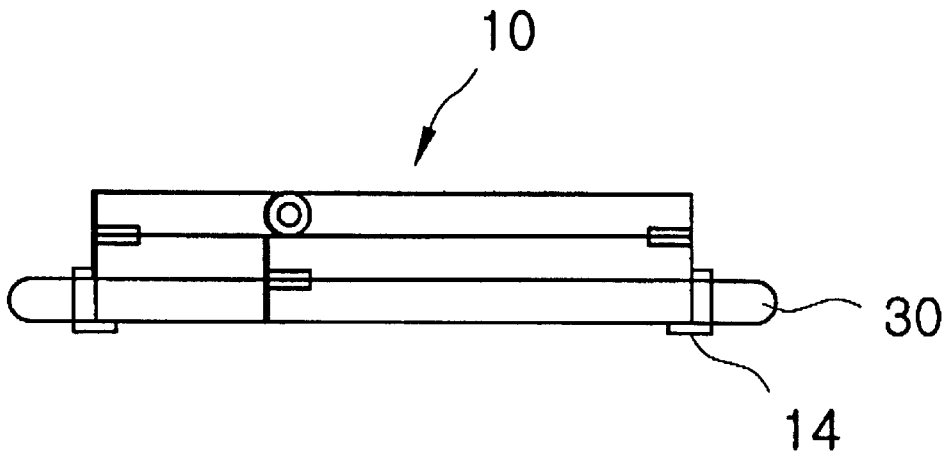
FIG. 8 is a view for showing the foldable bed for a vehicle shown in FIG. 1, which is contained in a trunk with first and second folding parts being folded and pivotal parts being pivoted.
Figure 9:
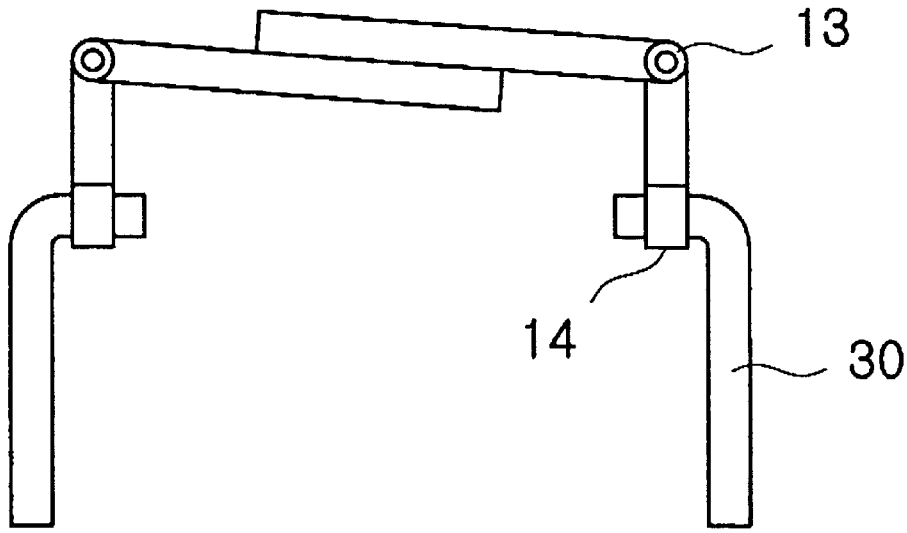
FIG. 9 is a view for showing the foldable bed for a vehicle shown in FIG. 1 from the inside of the vehicle, which is contained in a trunk with first and second folding parts being folded and pivotal parts being pivoted.

When folded in the opposite direction after folding the first foldable parts 11, the second foldable parts 12 are folded as shown in FIG. 4. Here, the pivotal part 13 in the left body 10 is bended right and folded, the pivotal part 13 of the right body 10 is bended left and folded so as to be in the positions as shown in FIG. 5 and FIG. 7. The bottom cloth 20 covering the surfaces of the bodies are folded together with the bodies 10. After that, the rotational members 14 of the bodies 10 connected to the first fixing parts 30 are rotated 90 degrees in the direction toward the trunk to be positioned as shown in FIG. 6, FIG. 8 and FIG. 9 and contained in the trunk.

Then, the back seat and the passenger's seat are returned in position and the second fixing part 40 is covered with a cover so that the vehicle may be run.

The foldable bed of the invention can be adjusted in length according to sizes of various vehicles by adjusting the distance between the first folding parts 11 and the second folding parts 12 or by varying the distance between the pivotal parts 13 and the rotational members 15 and the length of the bottom cloth 20 to be applied to all kinds of vehicles. The width of the foldable bed can be adjusted by varying the width of the first and second fixing parts 30 and 40 and the width of the bottom cloth 20.

As described above, according to the invention, a foldable bed is provided which can utilize spaces in the passenger's seat and back side of seats to serve for a rest of users in case of tiredness and to easily evacuate an emergent patient, thereby enhancing the convenience of the user.

While the invention has been particularly shown and described with reference to the preferred embodiment thereof, it will be understood by those skilled in the art that various changes in form and details may be made without departing from the spirit and scope of the invention. For example, a rectangular container can be modified so as to be installed in the isle bottom of a large sized bus for use in case of necessity.

What is claimed is:

1. A foldable bed for a vehicle comprising:

two side rails which have at least one folding part, the two side rails also have front and back ends, wherein the at least one folding part is in-between the front and back ends of the respective side rails;

pivotal parts attached to the front ends of each side rail and capable of swinging the two side rails in a plane parallel to a plane of said side rails;

trunk fixing parts which are in a trunk of the vehicle to be coupled with said pivotal parts;

fixing members located at said back ends of said side rails;

seat fixing parts which are at the front side of the vehicle passenger compartment to be coupled with said fixing members of said side rails; and a bottom cloth spanning between said side rails.

2. The foldable bed of claim 1, further comprising:

rotational members connected between respective pivotal parts and trunk fixing parts, said rotational member rotating about an axis connecting said rotary members.

3. The foldable bed of claim 1, wherein the said at least one folding part of said two side rails are a first and a second folding parts, and wherein said first folding parts of said two side rails are capable of folding the back ends of said side rails 180 degrees in a first rotational direction toward said front end of the respective side rails, and wherein said second folding parts of said two side rails are capable of folding a middle section, which is in-between said first and second folding parts, 180 degrees, in an opposite rotational direction of said first rotational direction, toward said front end of the respective side rail.

* * * * *